US005520732A

United States Patent [19]

Sarfati

[11] Patent Number: 5,520,732

[45] Date of Patent: May 28, 1996

[54] DEVICE FOR APPLYING A LIQUID TO A TRAVELING THREAD

[75] Inventor: Alberto G. Sarfati, Como, Italy

[73] Assignee: Sobrevin Société de brevets industriels-Etablissement, Vaduz, Liechtenstein

[21] Appl. No.: 221,754

[22] Filed: Apr. 1, 1994

[30] Foreign Application Priority Data

Apr. 8, 1993 [DE] Germany ..... 43 11 619.1

[51] Int. Cl.[6] ..... B05C 1/00

[52] U.S. Cl. ..... 118/234; 68/202; 118/240; 118/241; 118/256; 118/260; 118/681; 118/712

[58] Field of Search ..... 118/234, 240, 118/241, 256, 260, 268, 679–681, 712, 120, 123, DIG. 20, DIG. 22; 28/217, 265; 68/200, 202; 184/16, 64, 102

[56] References Cited

U.S. PATENT DOCUMENTS

| | | | |
|---|---|---|---|
| 2,463,111 | 3/1949 | Jones | 118/420 |
| 2,510,390 | 6/1950 | Dulken et al. | 68/202 |
| 3,053,222 | 9/1962 | Brierley et al. | 118/667 |
| 3,530,692 | 9/1970 | Schweizer et al. | 68/202 |
| 3,862,553 | 1/1975 | Schwemmer et al. | 68/202 |
| 4,845,964 | 7/1989 | Bors et al. | 68/202 |

FOREIGN PATENT DOCUMENTS

| | | |
|---|---|---|
| 0080843 | 6/1983 | European Pat. Off. . |
| 540244 | 9/1930 | Germany . |
| 802865 | 7/1949 | Germany . |
| 2803488 | 8/1979 | Germany . |
| 4113339 | 10/1992 | Germany . |

*Primary Examiner*—Laura Collins
*Attorney, Agent, or Firm*—Martin A. Farber

[57] ABSTRACT

A device for applying a liquid, for instance oil, to a traveling thread, having a rotatably mounted roll (1) extending into the line of the thread in order to receive a film of liquid on its surface (1') from a liquid reservoir (9) and transfer the liquid by surface contact. In order to improve the usefulness of such a device, a spatial separation of roll and reservoirs is provided. The liquid is to be transferred to the roll by a wick (6) which is arranged between the roll (1) and the reservoir (9).

15 Claims, 6 Drawing Sheets

3
5
21
20
4
23
1'
6
18
14
x
2
7
10
1
17
8
19''
19'
22
24
9
6
19

DEVICE FOR APPLYING A LIQUID TO A TRAVELING THREAD

FIELD AND BACKGROUND OF THE INVENTION

The present invention relates to a device for applying a liquid, for instance oil, to a traveling thread.

Various fields of use provide that threads must be lubricated with paraffin oil or the like. Different devices for this purpose are known in the prior art. For instance, it is known to have a thread travel through a rotating ring of paraffin. In this connection, this unit may also be placed in rotation by the thread itself. Another known device consists of a dish containing paraffin oil into which part of the surface of a rotatable roll dips. A thread is fed tangentially to the surface of the roll onto the unimmersed region of the roll. The rotation of the roll within the paraffin oil causes a thin film of paraffin oil to form on the surface of the roll. The thread is lubricated with this film of paraffin oil by the surface contact.

This device is disadvantageous since the paraffin oil reservoir becomes dusty upon the use of such a device in the vicinity of a loom. This disadvantage has the result that the paraffin oil reservoir must frequently be replaced and thus only small volumes can be used. Frequent refilling is necessary.

SUMMARY OF THE INVENTION

The object of the invention is to improve a device of this type with respect to its handling and use.

As a result of the development in accordance with the invention, in particular a yarn-waxing device is provided in which the reservoir can be kept substantially closed. A relatively large reservoir can be used. Furthermore, the roll can be arranged definitely apart from the reservoir so that an addition degree of freedom is obtained. The device can be arranged in a very small space and requires little maintenance. No open oil surface is any longer exposed to the fly dust. The roll can be displaced separately from the reservoir. In this way, adjustment of the application of the paraffin is possible. The additional transfer means arranged between roll and reservoir consists preferably of a wick. One end of this wick extends into the liquid reservoir while its other end wipes the surface of the roll. As a result of this development, mechanical liquid transfer aids such as pumps of the like are dispensed with. The liquid is transferred by the wick from the reservoir to the surface of the roll solely by capillary action. In this connection, the roll can either be kept in rotation by friction with the thread which travels over the roll or else, preferably, by a gear motor. A gear motor can, in this connection, be controlled by a control consisting preferably of a electronic control circuit. It is advantageous for the motor to be an electric motor, possibly both left- and right-rotating, which has an operating voltage of 12 V. The speed of rotation of the roll can then be established in such a manner that it turns with the speed of travel of the thread. However, it is also possible for the roll to turn in direction opposite the direction of travel of the thread. The control circuit then permits switching between clockwise and counterclockwise rotation of the drive motor. The speed of rotation can also be adjusted by the control proportional to the speed of the thread, which is possibly determined by a subsequent feed device. The separation of roll and reservoir permits displacement of the roll. It is therefore preferably provided that the roll is displaceable transverse to the direction of travel of the thread in the direction towards the travel of the thread. As a result of this displaceability, the wrap angle which is formed by the thread on the surface of the drum can be varied. The further the roll is pressed into the line of travel of the thread, and the more the thread therefore wraps around the roll, the greater the lubrication. The lubrication is accordingly adjustable via linear displacement of the roll. This direction of adjustment is preferably vertical. In order to assure the application of a uniform film onto the surface of the roll, the wick is pressed with a force against the roll. The force can come from a leaf spring, between the surface of which and the surface of the roll the wick is located. The leaf spring can, in this case, be fastened rigidly on the housing. By the wiping of the wick on the surface of the roll, a uniform of thickness of film on the one hand is obtained. On the other hand, any particles of dust which deposit on the roll are wiped off by the wick. From a construction standpoint, the arrangement of the reservoir vertically below the roll is advantageous. The reservoir is then housed within a container which is closed except for a passage for the wick. In particularly preferred manner, the device cooperates with a thread storage. The electronic control circuit which controls the drive of the roll is in signal communication with the drive of the thread storage. In this way, it is possible to synchronize the speed of removal of the thread or the speed of winding onto the thread storage with the speed of rotation of the roll. The roll then rotates in accordance with the speed of winding. With the thread in movement, the surface of the roll can have the same speed as the thread or a speed proportional to it and when the thread storage is stationary the roll stops. By the linear displaceability of the roll which with horizontal position of its axis is directed transverse to the travel of the thread the contact surface between the yarn and the lubricated roll can be changed. Since the reservoir is substantially unaffected by external influences, the container can have a relatively large volume, for instance 450 cc. As a whole, the entire device requires considerably less maintenance and is more favorable in handling as a result of the development in accordance with the invention. One further advantageous development of the invention provides that the reservoir into which the wick dips is filled with the liquid, for instance the oil, by an additional feed device. The additional reservoir can, in this connection, be a semicylindrical shell which can be arranged below the roll. On the top, this semicylindrical trough can be supplemented by a hood, also of semicylindrical shape, so as to form as a whole a cylindrical housing. The feed device is preferably a hose pump. In such case, a hose extends down to the bottom of the lower, larger reservoir. The other end of the hose extends into the upper, smaller reservoir which is to be filled. The structure pump preferably has three rollers which are arranged on a circular disk and turn as a result of a rotary movement of the circular disk. On the outside of the circle and between a hollow cylindrical covering, the hose is pressed circularly by the rolls against the cylindrical covering. By a milling movement of the rolls due to their rotation, the liquid is conveyed from the lower reservoir into the upper reservoir. A surprisingly simple construction of the device is obtained in the manner that the axis of the roll is at the same time the axis of the rotating disk of the hose pump. The two units can then be driven by a common drive motor. Hose pump and roll are preferably spaced axially from each other. An advantage resulting from the invention results from the fact that the reservoir into which the wick dips can be extremely small. In accordance with a further development, it is not even necessary for such a reservoir to be present. It is sufficient to keep the wick impregnated by the oil which continuously flows from the feed device. In addition, it is provided to wet the roll with the oil directly from the feed device. In that case, the wetting can also possibly be effected by a wick. To this extent, then, the mechanically driven feed device, for instance a peristaltic pump, assumes the function of the transfer means for the liquid.

BRIEF DESCRIPTION OF THE DRAWINGS

With the above and other and other advantages in view, the present invention will become more clearly understood in connection with the detailed description of preferred embodiments, when considered with the accompanying drawings of which.

DETAILED DESCRIPTION OF THE PREFERRED EMBODIMENTS

Figure 1:
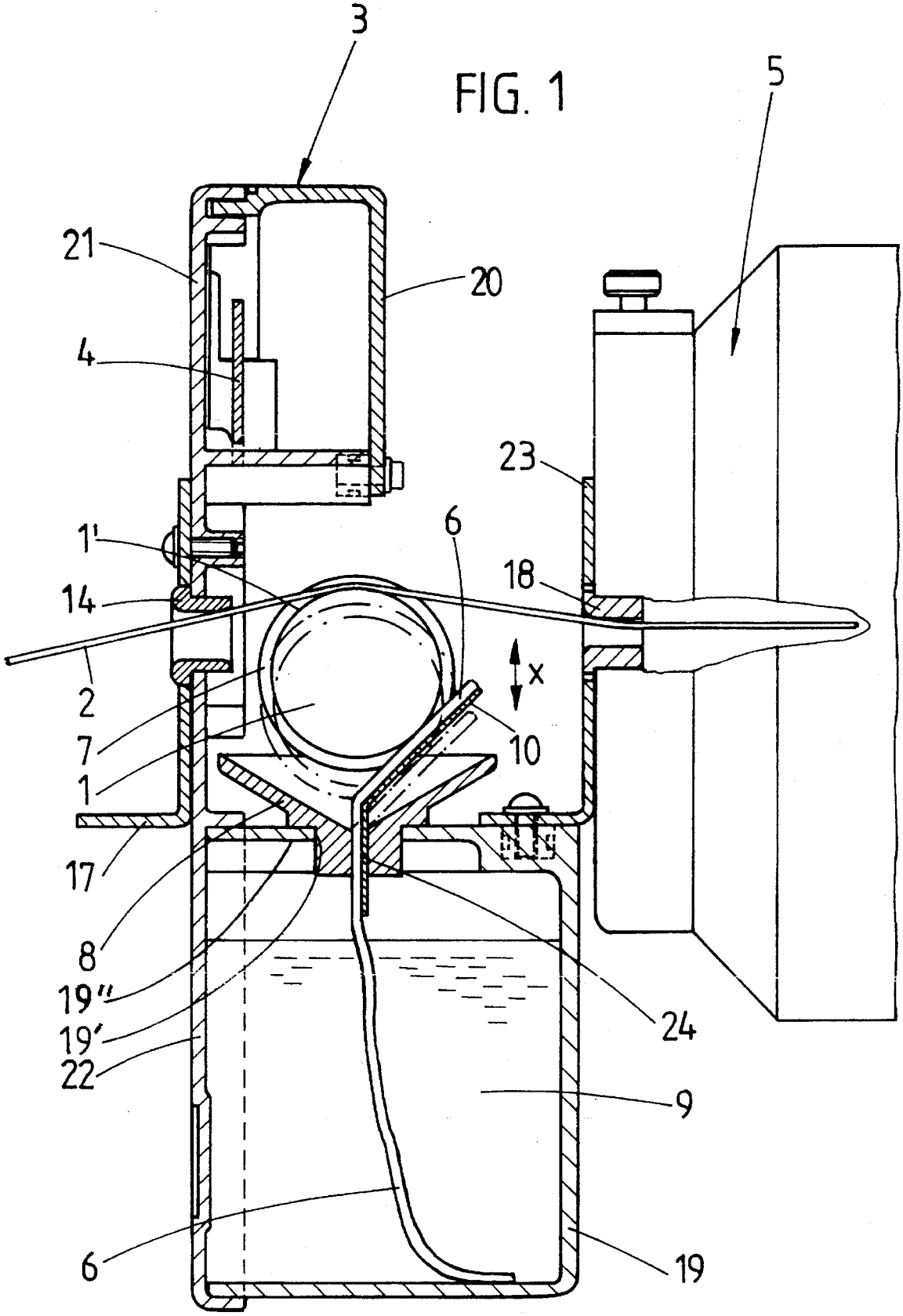
FIG. 1 is a side view, partially broken away, of a yarn-waxing device.
Figure 2:
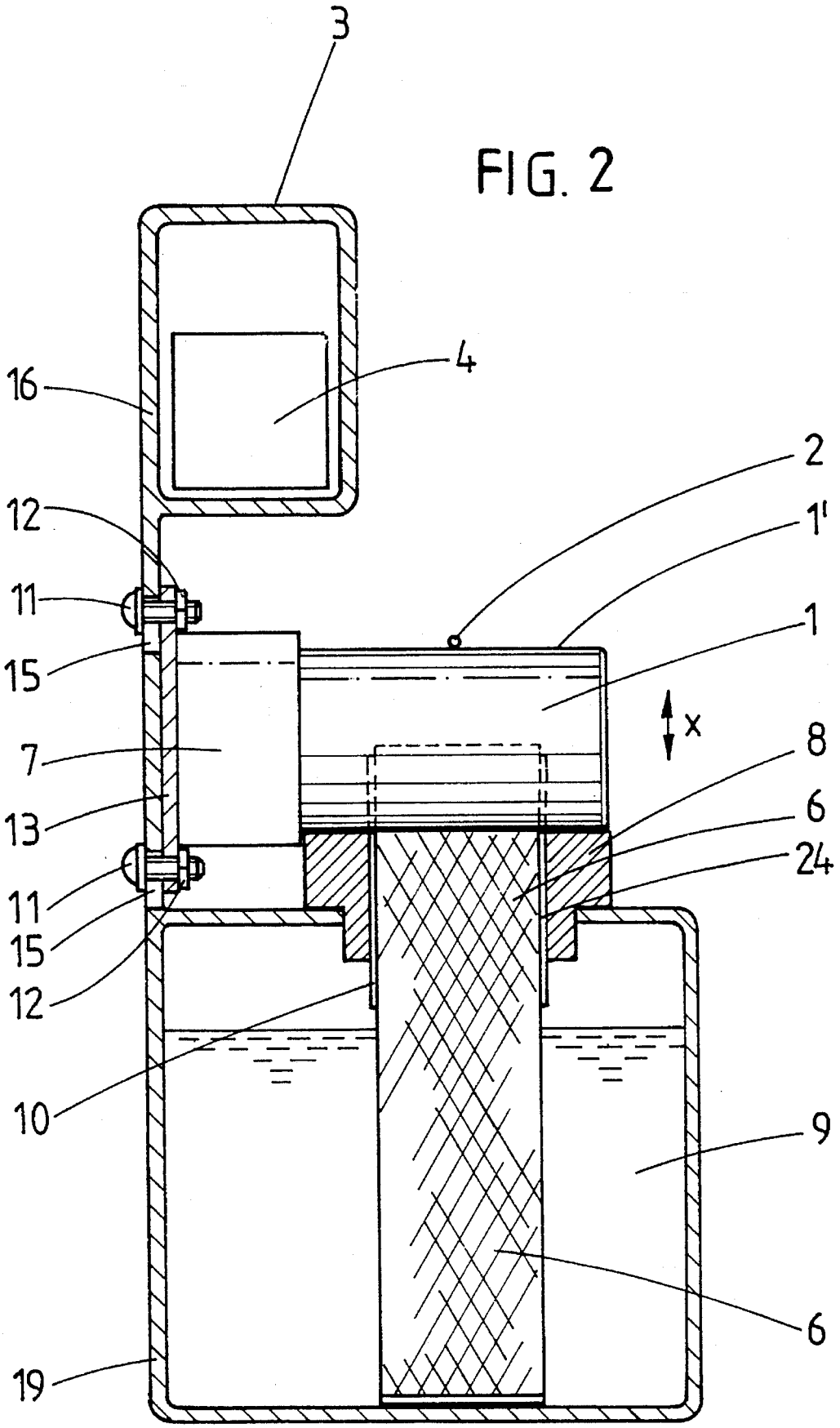
FIG. 2 is a rear view of a device according to FIG. 1, partially broken away.

In the embodiments the device, the yarn-waxing apparatus, is screwed directly onto the bottom of a thread storage 5. As fastening means, there is used the device holder 23 which is bolted onto said bottom. The thread storage is fastened with its drum (not shown) in horizontal position in the customary manner. The thread 2 also extends substantially horizontally and enters into the yarn-waxing device through the inlet eye 14 and passes out of the device through the inlet eye 18 of the thread storage 5. The two eyes lie substantially in the same horizontal plane.

Between the inlet eye 14 and the inlet eye 18 there is arranged a roll 1 which is driven by a drive motor (electric gear motor) 7. In this connection, the axis of the roll 1 is aligned with the motor 7 which on one side has a holding plate which is held in vertically displaceable manner by screws or other fastening means on the side wall 16 of the device. The motor is an electric motor for low-voltage direct current and can be operated in both directions of rotation.

On the side wall, above the drive motor 7, there is a housing 3 to receive a circuit 4. The circuit 4 is an electric circuit and forms the control for the drive motor 7. The circuit 4 is in signal communication with the thread storage and/or with the drive control of the thread storage 5 so that the roll drive 7 can be synchronized with the drive of the thread storage. Roll and thread storage travel in synchronism or in proportional operation. The housing of the control 3 consists of a cover 20 of a rear wall 21.

Below the roll there is a container 19 which receives an oil reservoir 9. The container has a volume of approximately 450 cc. A wick 6 extends into the container down to the bottom of it. This wick is brought out of the container through a wick passage 24 arranged on the top of the container and rests there against a leaf spring 10. The leaf spring 10 is bent at an angle and one bent arm is also fastened in the wick passage 24. The leaf spring 10 clamps the wick 6 between itself and the surface 1' of the roll so that the wick 6 is pressed against the surface 1' of the roll 1. The leaf spring 10 and the wick 6 are of such length that, despite vertical movement of the roll, the wick is always pressed against the surface of the roll due to the spring resiliency of the leaf spring 10. Directly below the roll, there is an oil-collection funnel which is wider than the diameter of the roll 1 and approximately of the same length as the roll. The collecting funnel tapers downward to the wick passage. As separate structural part, the oil-collection funnel 8 extends into a central opening 19' in the cover region 19" of the container. It also bears the leaf spring 10. The wick 6 is of strip shape and consists of a fabric which is adapted to transfer the oil by capillary action from the reservoir 9 to the surface 1' of the roll. The width of the wick 6 is many times wider than the width of the thread 2. In the case of wide threads it may, however, merely be slightly wider than the thread 2.

The roll can be displaced in the direction x into the straight line extending through the inlet eye 14 and the outlet eye 18, in which case said line intersects the body of the roll. As a result of the displaceability of the roll 1 together with the drive motor 7 in the direction x, the thread 2 is deflected by a larger or smaller amount depending on the position of the roll. The contact surface between thread 2 and roll 1 is determined by the amount of deflection of the thread 2. Upon its displacement, the roll 1 is displaced into the direction of alignment of the two eyes 14 and 16. By the rotation of the roll, its surface 1' is provided with a thin film of oil. Upon operation, the speed of rotation of the roll corresponds to the speed of travel of the thread or is proportional to it. In such case, the film of oil is optimally applied to the thread. Any particles of dust which fall on a film of oil are wiped off by the wick due to the application of the wick against the surface 1' of the roll 1.

Figure 3:
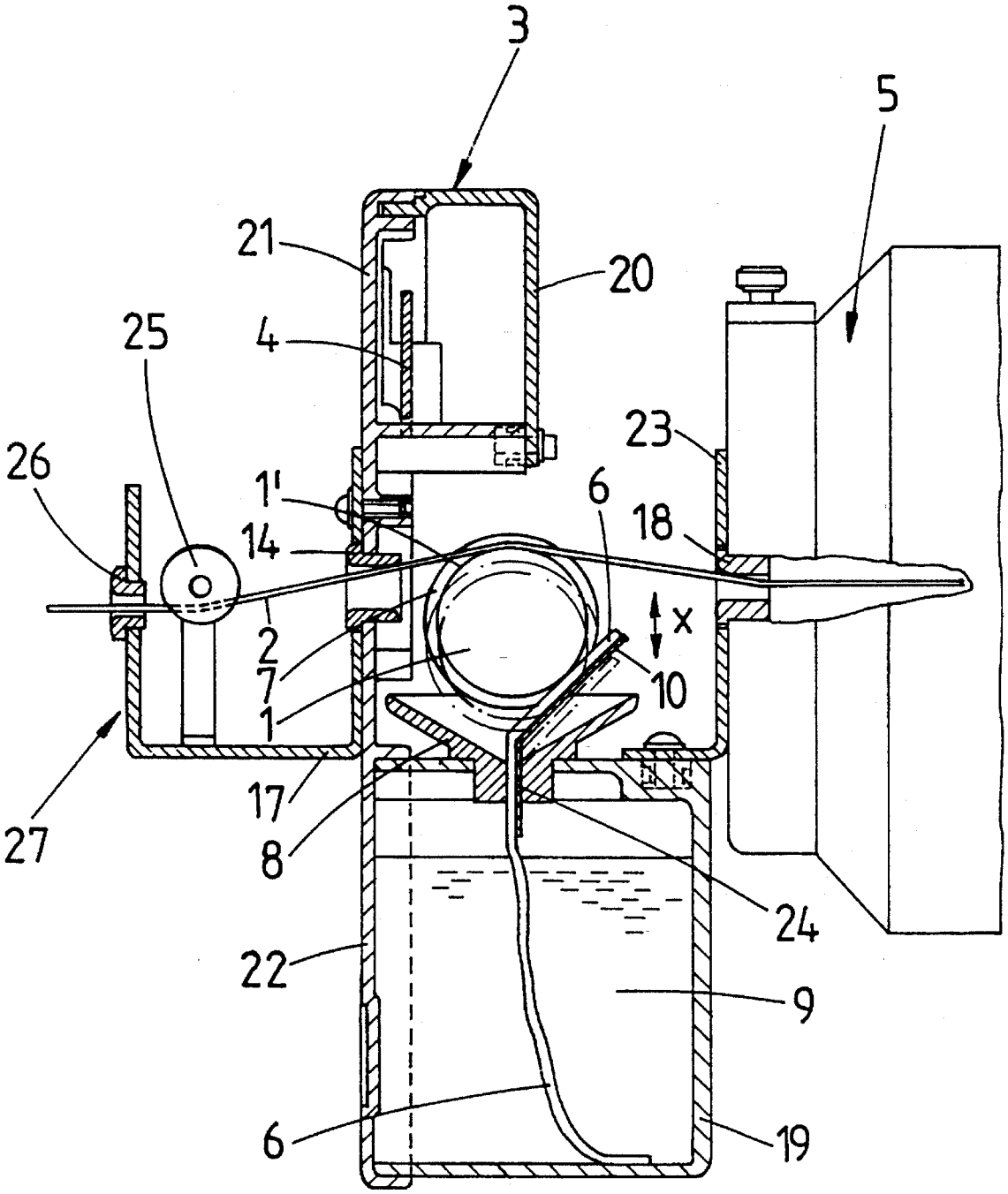
FIG. 3 shows another embodiment with a thread brake arranged in front of it, in a view similar to FIG. 1.

On the rear wall 21 of the apparatus there is a holding plate 17 for a thread brake. In order to achieve optimal lubrication, it is provided that a yarn-waxing device, such as described for instance in the present application, be arranged between a thread brake 27 and a thread storage 5. Such an embodiment is shown in FIG. 3. In a device according to the invention, the necessary thread tension with which the thread 2 rests on the drum 1 is then always assured. In this embodiment also, the roll lies horizontally and can be displaced in vertical direction. The displacement can be effected in the manner that the drive motor is fastened to a holding plate 17 which is fastened displaceable parallel to the side wall 16, on the side wall. The attachment can be effected by bolts 11 and nuts 12 which extend through a slot 15 in the side wall 16. The alignment of the slot or slots 15 is in this connection in the direction of displacement x of the roll 1. The displaceability of the roll 1 can, however, also be effected by other means, for instance by a spindle drive. In such case, the spindle drive can be driven manually or by motor. In this embodiment also, it is advantageous for the axis of rotation of the roll 1 to be directed askew to the direction of travel of the thread. In projected view, the thread can then be fed at an angle as well as perpendicular to the axis of the roll 1.

The arrangement shown in FIG. 3 consists of a thread brake 27, a yarn-waxing device and a thread storage 5. The thread brake has an inlet eye 26 which is substantially aligned with the inlet eyes 14 and 18. In the path of the thread there is a thread brake which consists of two cup springs 25. For the braking, the thread 2 is passed between two cup springs 25 which are spring loaded against each other.

Below the holding plate 17 there is an anti-ballooning disk 22.

The features of the invention disclosed in the above specification, the drawing and the claims can be of importance individually and in any desired combination for the reduction to practice of the invention. All features disclosed are essential to the invention. The disclosure of the corresponding/accompanying priority papers (copy of prior application) is herewith also included in its entirety in the disclosure of the application.

Figure 4:
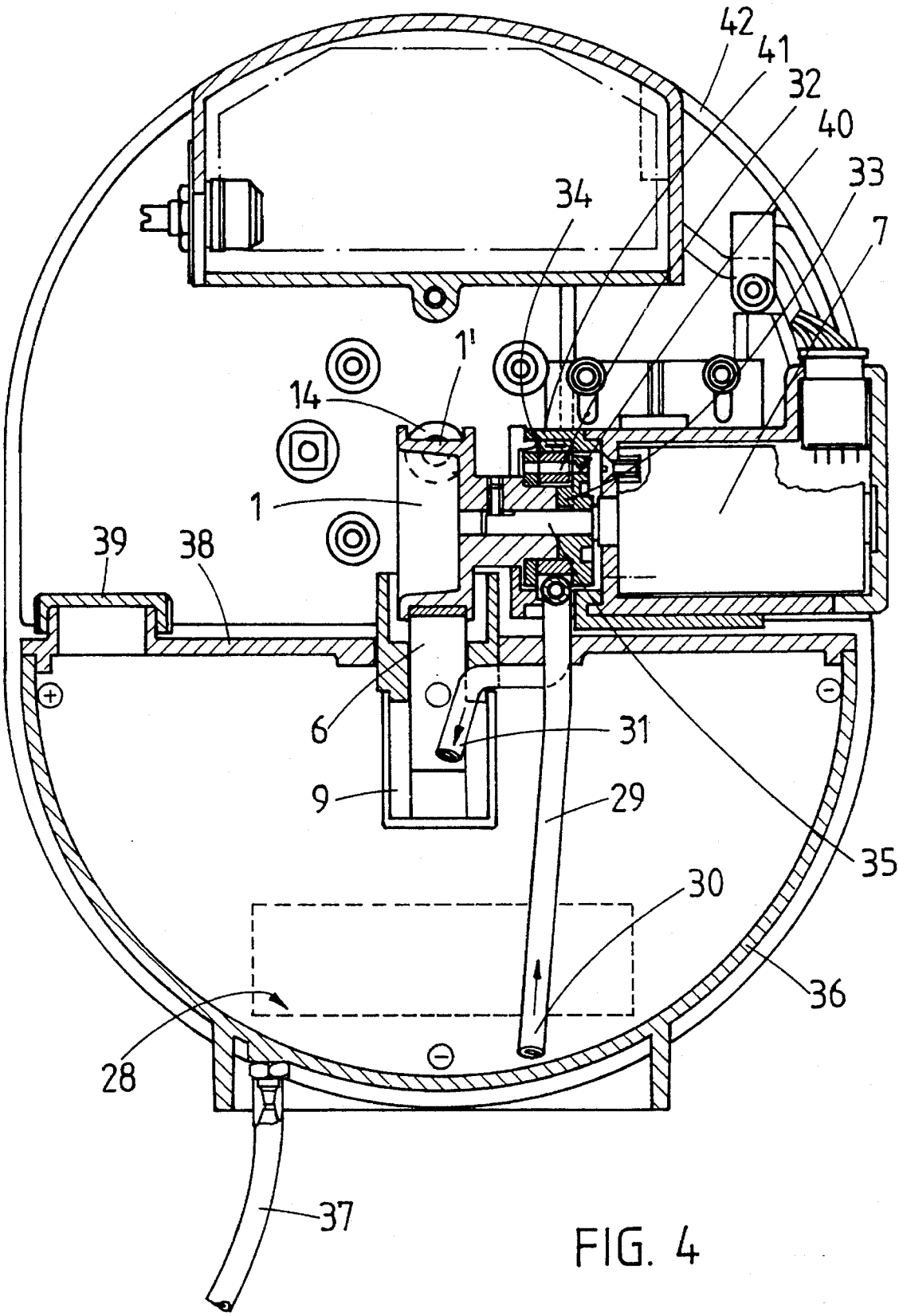
FIG. 4 shows another embodiment of the invention, in section, along the line IV—IV of FIG. 5.
Figure 5:
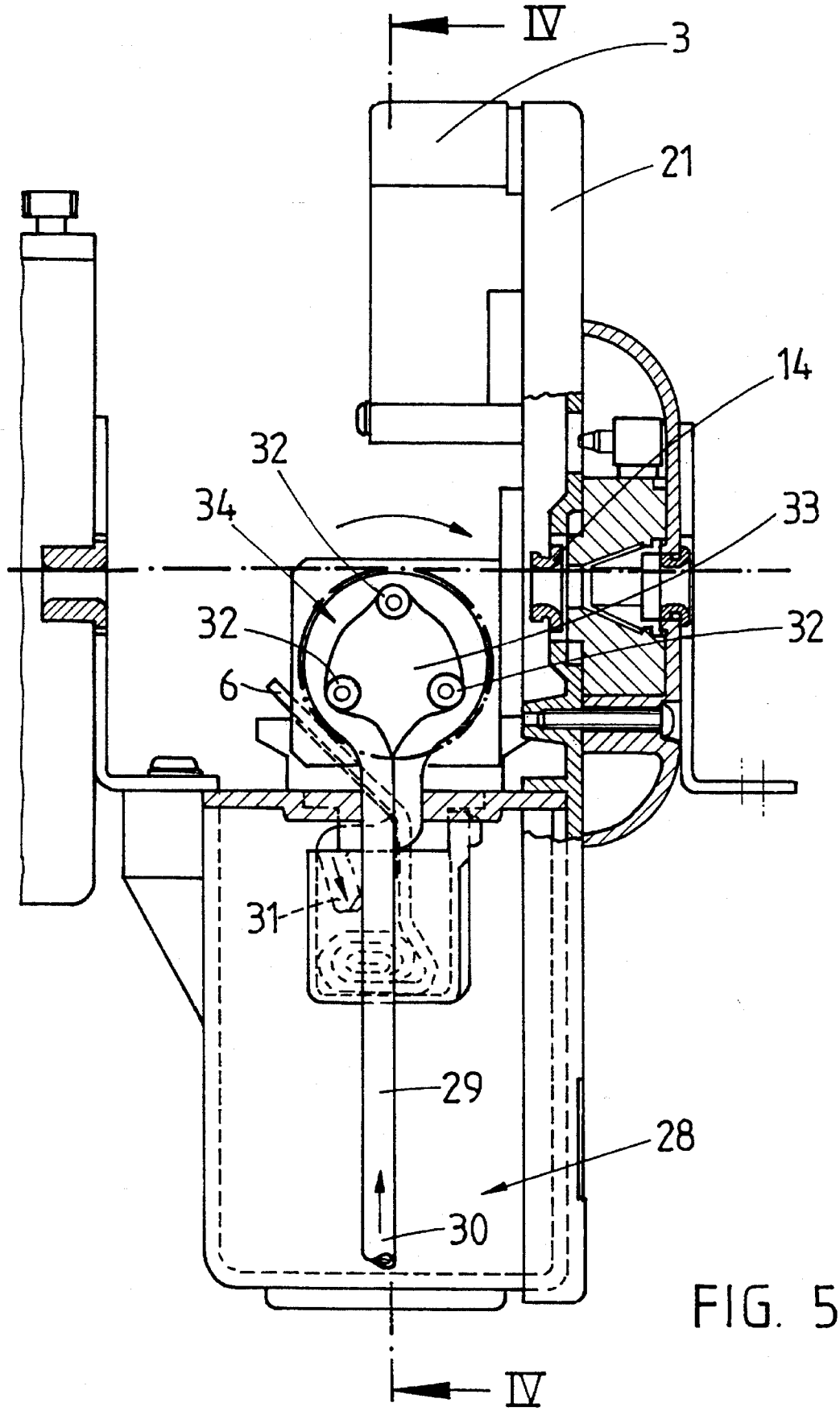
FIG. 5 is a view of the embodiment of FIG. 4, partly in section and partly with details which are broken away.
Figure 6:
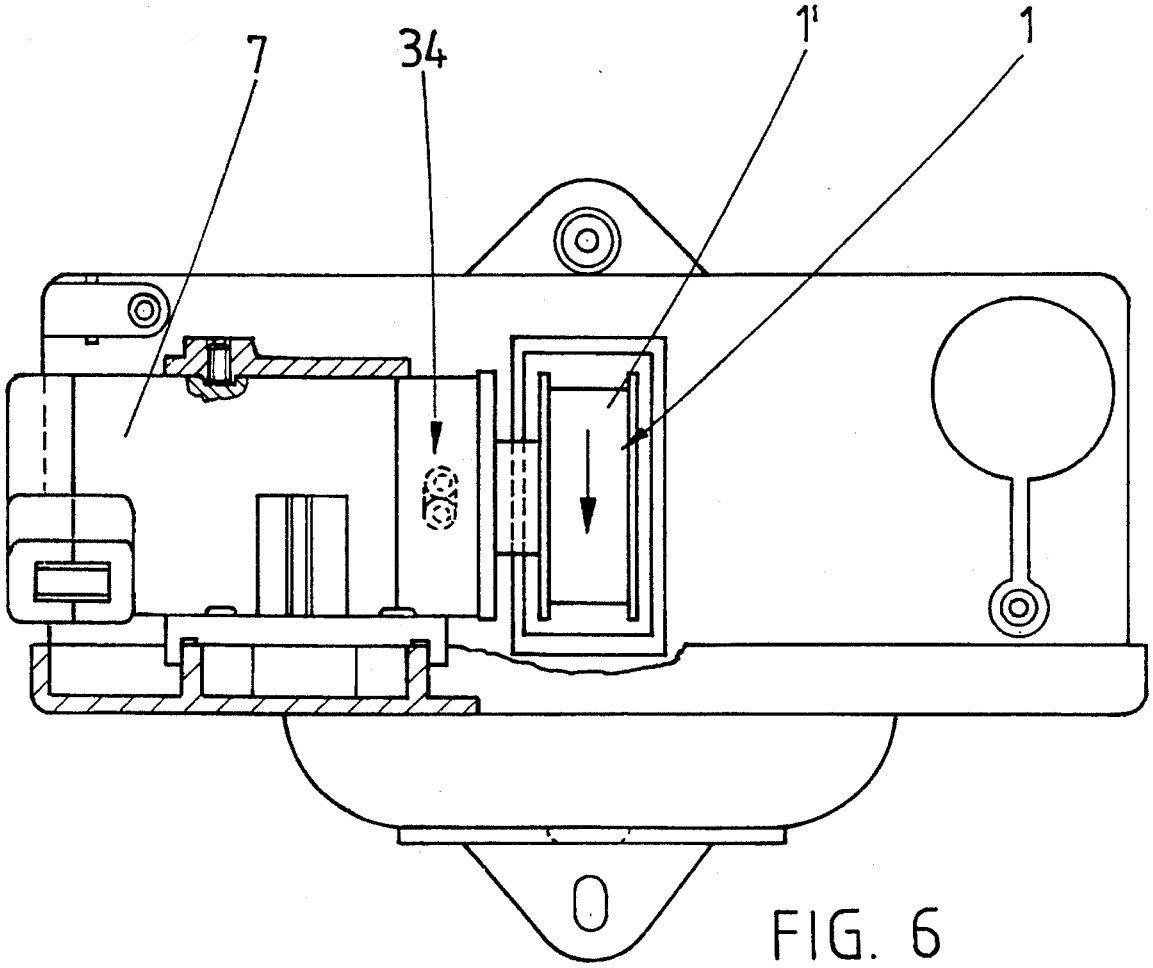
FIG. 6 is a top view of an object according to FIG. 4, partially in section.

The apparatus for applying a liquid in accordance with the embodiment shown in FIGS. 4 to 6 operates in principle in exactly the same manner as the embodiment described in detail above. Reference is therefore had to the details described there. In addition to a first reservoir 9, into which the wick 6 which lies on the surface 1' of the roll extends, there is a larger oil supply in a larger reservoir 28. The reservoir 28 is formed by a semicylindrical through 36 which is arranged below the reservoir 9. Towards the top, the semicircular trough 36 is covered by a cover 38 which, at the same time, forms the holding bottom plate for the reservoir 9 and/or the drive motor 7. An opening in the cover 38 of the reservoir 28 is closed by a lid 39. This lid can be removed. Oil can be introduced into the reservoir 28 through the opening present below it.

The reservoir 9 and the reservoir 28 are connected to each other by a hose 29. The one end 30 of the hose 29 extends to the bottom of the reservoir 28. The other end 31 of the hose extends through an opening into the reservoir 9. By a hose pump 40 arranged on the hose, liquid can be pumped from the reservoir 28 through the hose 29 in the direction indicated by the arrow into the reservoir 9. The liquid is then conducted from this reservoir 9 by the wick onto the surface 1' of the roll 1 as a result of capillary forces.

The hose pump has in known manner a cylindrical shell 41. Within this hollow shell there is located a hose 29. By means of three rollers 32 arranged on a rotating disk 33, the hose is pressed against the surface 41 of the shell. By a rotation of the disk 33, a milling movement takes place in the hose so that the liquid is conveyed in known manner.

The shaft 35 of the hose pump 40 is preferably formed by the drive shaft of the roll 1 and is connected to the drive motor 7. Roll 1 and hose pump 40 accordingly are coaxial to each other and are driven with the same speed of rotation. As a result of this development, a considerable reduction in the number of structural parts is obtained. It is merely necessary for one drive motor to be present in order to drive both the roll and the pump.

On the bottom of the trough 36 there is a hose connection 37, which serves either for the filling or the discharge of the liquid from the reservoir 28. Above the cover 38 there can be also a semicylindrical hood 42 on which the receiving chamber for the electronic circuit is also arranged. The hood 42 can supplement the trough 36 so as to form a cylindrical body. In addition, an overflow can be provided on the reservoir 9 if the feed speeds of pump and wick are different. However, it is contemplated that the speed of conveyance of the pump is higher than that of the wick so that sufficient liquid is always present in the reservoir 9. The liquid which flows out over the overflow can drop into the trough 36 which is arranged directly below the reservoir 9.

I claim:

1. A device for applying a liquid to a traveling thread, comprising:

a liquid reservoir, a funnel, and a rotatably mounted roll which extends into a line of the thread to receive a film of liquid on a surface of the roll from the liquid reservoir, the roll applying the liquid by surface contact to the thread;

wherein said funnel is disposed between said roll and said reservoir;

a wick extending through said funnel and having a first end and a second end opposite the first end, said reservoir being located below said roll, the first end of said wick extending into said reservoir, and the second end of said wick wiping against the surface of said roll for applying liquid from the reservoir to the surface of said roll;

means for urging the second end of said wick against the surface of said roll at a lower portion of said roll, and wherein the thread travels substantially horizontally and wipes against the surface of said roll upon an upper portion of said roll; and liquid from said reservoir travels upward by capillary action through said wick to contact the surface of said roll.

2. A device according to claim 1, further comprising a container which is arranged below the roll and receives the reservoir, the container being closed during operation of the roll and providing a passage for the wick.

3. A device for applying a liquid to a traveling thread, comprising:

a liquid reservoir, a funnel, and a rotatably mounted roll which extends into a line of the thread to receive a film of liquid on a surface of the roll from the liquid reservoir, the roll applying the liquid by surface contact to the thread, said reservoir having a cover and a central opening disposed in said cover for receiving said funnel;

wherein said funnel is disposed between said roll and said reservoir for collecting excess liquid from the surface of said roll and for returning the excess liquid to said reservoir;

said device further comprises a wick and a leaf spring arranged parallel to said wick, said wick being disposed in said funnel for substantially closing said liquid reservoir and preventing dust from entering said reservoir, said wick having a first end and a second end opposite the first end, said reservoir being located below said roll, the first end of said wick extending into said reservoir, and the second end of said wick wiping against the surface of said roll for applying liquid from the reservoir to the surface of said roll;

wherein said wick wipes, under the action of a force of said leaf spring, against a lower portion of said roll and liquid from said reservoir travels upward by capillary action through said wick to contact the surface of said roll.

4. A device according to claim 3, further comprising a motor for rotating said roll.

5. A device according to claim 3, further comprising electronic control means for controlling a speed of rotation of said roll.

6. A device according to claim 3, wherein the roll rotates with a speed of travel of the thread.

7. A device according to claim 3, wherein the roll is displaceable transversely to a direction of travel of the thread.

8. A device according to claim 3 wherein the axis of the roll is arranged in a horizontal direction with its axis askew to a line of the thread.

9. A device according to claim 3, further comprising a thread storage having a thread drive, and a drive for the roll which is synchronizable with said drive of the thread storage.

10. A device according to claim 9 further comprising an electronic control circuit which is in signal communication with the thread storage.

11. A device according to claim 9, further comprising a thread brake located at a thread feed side of the thread storage.

12. A device according to claim 3, wherein said reservoir is a first reservoir, and the device further comprises a second reservoir of larger volume than the first reservoir and arranged below the first reservoir; and conveying means in fluid communication with said first reservoir for conveying liquid from the second reservoir into the first reservoir.

13. A device according to claim 12, wherein the conveying means comprises a hose pump arranged coaxial to the roll, and a drive motor which drives both the pump and the roll.

14. A device according to claim 12, wherein the conveying means comprises a peristaltic pump having a delivery output greater than a delivery output of the wick.

15. A device for applying a liquid to a traveling thread, comprising:

a liquid reservoir, a funnel, and a rotatably mounted roll which extends into a line of the thread to receive a film of liquid on a surface of the roll from the liquid reservoir, the roll applying the liquid by surface contact to the thread;

wherein said funnel is disposed between said roll and said reservoir;

means for guiding the thread substantially horizontally against the surface of said roll upon an upper portion of said roll;

a wick extending through said funnel and having a first end and a second end opposite the first end, said reservoir being located below said roll, the first end of said wick extending into said reservoir, and the second end of said wick wiping against the surface of said roll for applying liquid from the reservoir to the surface of said roll;

means for urging said second end of said wick against the surface of said roll at a lower portion of said roll, and wherein the thread travels substantially horizontally via said guiding means and wipes against said surface of said roll upon said upper portion of said roll; and liquid from said reservoir travels upward by capillary action through said wick to contact the surface of said roll.

* * * * *